US009103053B2

(12) United States Patent
Meyer et al.

(10) Patent No.: US 9,103,053 B2
(45) Date of Patent: Aug. 11, 2015

(54) METHOD FOR OPERATING AN OPEN-END ROTOR SPINNING MACHINE

(71) Applicant: Saurer Germany GmbH & Co. KG, Remscheid (DE)

(72) Inventors: Jurgen Meyer, Aachen (DE); Maximilian Preutenborbeck, Monchengladbach (DE); Michael Spitzer, Korschenbroich (DE); Heinz-Georg Wassenhoven, Monchengladbach (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 0 days.

(21) Appl. No.: 14/266,293

(22) Filed: Apr. 30, 2014

(65) Prior Publication Data

US 2014/0360151 A1 Dec. 11, 2014

(30) Foreign Application Priority Data

May 11, 2013 (DE) ..... 10 2013 008 107

(51) Int. Cl.
*D01H 1/14* (2006.01)
*D01H 4/50* (2006.01)
*D01H 4/44* (2006.01)

(52) U.S. Cl.
CPC . *D01H 1/14* (2013.01); *D01H 4/44* (2013.01); *D01H 4/50* (2013.01)

(58) Field of Classification Search
CPC ..... D01H 4/08; D01H 4/50; D01H 13/005; D01H 15/00
USPC ..... 57/264, 404–417
See application file for complete search history.

(56) References Cited

U.S. PATENT DOCUMENTS

| | | | | |
|---|---|---|---|---|
| 3,447,298 | A | 6/1969 | Collins | |
| 4,676,059 | A | 6/1987 | Artzt et al. | |
| 4,787,198 | A * | 11/1988 | Stahlecker | 57/401 |
| 4,884,394 | A * | 12/1989 | Campbell et al. | 57/264 |
| 4,893,462 | A * | 1/1990 | Braun et al. | 57/302 |

(Continued)

FOREIGN PATENT DOCUMENTS

| | | |
|---|---|---|
| DE | 1685921 A1 | 2/1972 |
| DE | 3441677 A1 | 2/1986 |

(Continued)

OTHER PUBLICATIONS

German Search Report for Priority German Patent Application No. DE 10 2013 008 107.6.

(Continued)

*Primary Examiner* — Shaun R Hurley
(74) *Attorney, Agent, or Firm* — Nelson Mullins Riley & Scarborough LLP

(57) ABSTRACT

A method for operating an open-end rotor spinning machine having a plurality of workstations, usually a large number, each including a spinning device with a rotor housing, to which negative pressure can be applied, in which a spinning rotor (23) revolves at a high rotational speed, to produce a yarn, as well as a winding device to produce a cross-wound bobbin (18), wherein the connection of the workstations to a central negative pressure supply can be selectively switched off. The application of negative pressure to the rotor housing is limited to the spinning devices which are producing yarn as well as the spinning devices which are repiecing.

1 Claim, 2 Drawing Sheets

(56) References Cited

U.S. PATENT DOCUMENTS

| | | | | |
|---|---|---|---|---|
| 5,305,983 | A | 4/1994 | Haase et al. | |
| 5,802,835 | A * | 9/1998 | Stephan | 57/304 |

FOREIGN PATENT DOCUMENTS

| | | | |
|---|---|---|---|
| DE | 3726531 | C1 | 12/1988 |
| DE | 102006037849 | A1 | 2/2007 |
| DE | 102007006679 | A1 | 8/2008 |
| EP | 0378931 | A1 | 7/1990 |
| EP | 0529312 | B1 | 3/1993 |
| WO | 2008/095611 | A1 | 8/2008 |

OTHER PUBLICATIONS

European Search Report for European Patent Application No. EP 14 00 1274, dated Sep. 23, 2014, 2 pages.

* cited by examiner

METHOD FOR OPERATING AN OPEN-END ROTOR SPINNING MACHINE

CROSS-REFERENCE TO RELATED APPLICATIONS

This application claims priority from German National Patent Application No. 10 2013 008 107.6, filed May 11, 2013, entitled "Verfahren zum Betreiben einer Offenend-Rotorspinnmaschine, the entire contents of which are incorporated herein by reference.

FIELD OF THE INVENTION

The present invention relates to a method for operating an open-end rotor spinning machine, having a plurality of workstations, usually large in number, which in each case have a spinning device with a rotor housing, to which negative pressure can be applied, in which a spinning rotor revolves at a high rotational speed, for producing a yarn, as well as a winding device for producing a cross-wound bobbin, wherein the connection of the workstations to a central negative pressure supply which can be selectively switched off.

BACKGROUND OF THE INVENTION

Open-end rotor spinning machines have been known for a long time and generally consist of a large number of similar workstations arranged next to one another in a row. In addition, they have a central control mechanism as well as a negative pressure system particular to the spinning machine Each of these workstations has a spinning and a winding device, on which a fiber band (commonly referred to as a sliver) presented in a spinning can is spun to form a yarn and is wound to form a cross-wound bobbin.

The fiber band is fed by means of a fiber band feed cylinder to an opening cylinder which, with its clothing, opens the fiber band into individual fibers and transports them to a fiber guide channel of the spinning box. The fiber transport is assisted by negative pressure existing in the rotor housing, which produces an air stream in the fiber guide channel, releases the fibers from the opening clothing and conveys them in a targeted manner into the spinning rotor by means of a so-called channel plate adapter. Owing to the centrifugal acceleration of the spinning rotor, the fibers slide into a collecting groove of the spinning rotor, are collected there, are drawn off axially by a withdrawal nozzle in the rotational axis of the rotor and thus rotated to form a yarn that is wound onto a cross-wound bobbin.

After a stoppage of the rotor spinning machine or after a yarn break, the spinning process has to be resumed. For reconnecting the trailing end of yarn previously formed to fibers in the spinning rotor, called piecing, the trailing yarn end is guided counter to the yarn withdrawal direction into the yarn withdrawal tube of the spinning chamber and suctioned in by the negative pressure in the rotor housing. The cross-wound bobbin is pivoted down, in other words brought into contact with a bobbin drive roller again and as soon as the yarn end reaches the collecting groove of the spinning rotor or the fiber ring located therein, the yarn end breaks open the fiber ring and the spinning process can be continued.

An open-end rotor spinning machine, which, in the suction line for producing the negative spinning pressure in the rotor housing, has a valve with rapid venting, is disclosed by European Patent Publication EP 0 529 312 B1. The suction of the rotor housing is interrupted before piecing by means of the valve. As a result, the fibers are not suctioned, as usual during the spinning process, through the fiber guide channel, but through the suction opening of the opening roller. With the introduction of the yarn end into the spinning rotor and by opening the valve, the rotor housing again has negative pressure applied. The suction through the suction opening of the opening roller is ended so as to be synchronized with this with respect to time. A more uniform yarn piecing is to be produced by this deflection of the fiber stream during the piecing process.

German Patent Publication DE 10 2006 037 849 A1 discloses an open-end spinning machine and a method for controlling an open-end spinning machine during a setting process when repiecing a yarn or after a yarn break. Proceeding from the fact that during repiecing after the closing of the housing, the rotor interior is cleaned by means of so-called rinsing air of subsequently introduced impurities that have accumulated there, that each spinning station requires its own rinsing air guide for this step and that the automatic piecing mechanisms or maintenance mechanisms additionally must have corresponding connections to introduce the rinsing air, a repiecing of the yarn is to be made possible with reduced outlay with respect to the device and method.

For this purpose, according to German Patent Publication DE 10 2006 037 849 A1, upon a stoppage of the fiber band feed or after a predetermined time period, the negative pressure present in the housing is immediately interrupted. This results in the prevention of the fiber band end being drawn by the air, which continues to flow in, to the opening mechanism and prevents the occurrence of an undesired suctioning in of impurities before the housing of the spinning station is closed. In addition, energy can be saved in this manner as a considerable quantity of additional air is suctioned into the machine through the opened housing when negative pressure is present, which would in turn lead to a pressure increase within the pressure systems.

The drawback in the methods and devices according to the prior art, is, however, that the rotor housings of the individual workstations permanently have negative pressure applied up until the piecing process or the cleaning process connected therewith.

This has a negative effect quite particularly after a restart of the machine or run up after a power failure. As all the workstations have negative pressure applied and additional mechanisms, such as for example, the suction nozzle for grasping the upper yarn or a pneumatic yarn store, which also require negative pressure, are used for piecing, the negative pressure available overall is reduced. Therefore, in a rotor spinning machine with self-sufficiently piecing spinning stations, only a limited number of the spinning stations, e.g., only 12 stations, can repiece simultaneously, as the negative pressure is not sufficient for piecing at further workstations, including the additional mechanisms necessary for this process.

SUMMARY OF THE INVENTION

Proceeding from the aforementioned prior art, the invention is based on the object of developing a method, which optimizes the negative pressure consumption at an open-rotor spinning machine.

This object is achieved by a method for operating an open-end rotor spinning machine having a large number of workstations, which in each case have a spinning device with a rotor housing, to which negative pressure can be applied, in which a spinning rotor revolves at a high rotational speed, to produce a yarn, as well as a winding device to produce a cross-wound bobbin, wherein the connection of the workstations to a central negative pressure supply can be switched off To achieve the object according to the present invention, the application of negative pressure to the rotor housing is limited to the spinning devices which are producing yarn as well as the spinning devices which are repiecing. Additional features of the invention provide further advantageous configurations as described further herein. The advantages achieved by the invention consist, in particular, in that the negative pressure necessary for spinning is only provided for the spinning devices of the individual workstations when the respective workstation is producing yarn or a yarn is repieced.

Previously the procedure in practice was that the negative pressure was fed constantly to all spinning devices, regardless of the fact of whether the spinning device was producing yarn. As, however, some of the spinning devices are often not producing, for example because of yarn interruptions, a cross-wound bobbin change or because not all the workstations are occupied, the negative pressure supply according to the prior art is ineffective.

In particular after a machine start or run up after a power failure, the negative pressure for spinning is exclusively required for the workstations that are to be pieced and those already producing.

When applying the present invention, the machine can be run up more quickly. As exclusively the spinning stations that are actually also piecing have negative pressure applied, more spinning stations can now be simultaneously pieced according to the invention. While, during a machine run-up, about 12 piecing stations could previously be pieced simultaneously, with the method according to the invention now more than 20 spinning stations can be pieced simultaneously. In this manner, the useful effect of the open-end rotor spinning machine is reached more quickly.

Furthermore, an optimized negative pressure consumption adapted to need is produced for an open-end rotor spinning machine. By optimizing the suction power, the energy consumption and therefore the costs connected therewith can be reduced without impairing the productivity of the machine or the yarn quality. Particularly at present, when energy costs make up a not insignificant proportion of the operating costs, reducing the consumption is an important instrument to be able to produce more economically. In addition the lower energy consumption is environmentally friendly.

According to a further aspect of the invention, it is provided in an advantageous embodiment that the control of the entire machine negative pressure takes place depending on the number of workstations that are supplied with negative pressure.

By means of the valve in the suction line for producing the negative spinning pressure in the rotor housing, the entire suctioning-in cross-section of the air system is limited to the necessary amount, which in turn leads to an increase in the system negative pressure. With corresponding control, this increased negative pressure can be reduced again to a previously adjusted pressure value by reducing the rotational speed of the fan. The rotational speed reduction leads to an overall reduced power consumption.

As, in particular, the application of negative pressure to the rotor housing may take place individually for each individual workstation or in groups for a plurality of workstations.

Because of these flexible possibilities, an individual stationary workstation can, for example, be removed from the negative pressure application to the rotor housing, although it is surrounded by workstations producing yarn. However, it may also be sensible to switch non-producing groups of workstations. Depending on need, this may be sections or also section sides. If, for example, the open-end rotor spinning machine is producing temporarily only on the workstations of one machine side, the entire side, the workstations of which are stationary, can be excluded from the negative pressure supply. This would, for example, be possible by an additional branching off of the negative pressure channel system that applies negative pressure to the sections or machine sides.

According to a further feature of the invention, it may advantageously also be provided that a direct or a derived signal initiates the application of negative pressure to the rotor housing.

In order to activate the valve to switch off the negative pressure to the rotor housing, either direct signals, such as the report of a "yarn break" or "machine run up" or derived signals, such as, for example, "bobbin lifting" can be processed. With the arrival of a signal of this type, the valve is actuated and the negative pressure is no longer fed to the rotor housing.

DETAILED DESCRIPTION OF THE PREFERRED EMBODIMENTS

Figure 1:
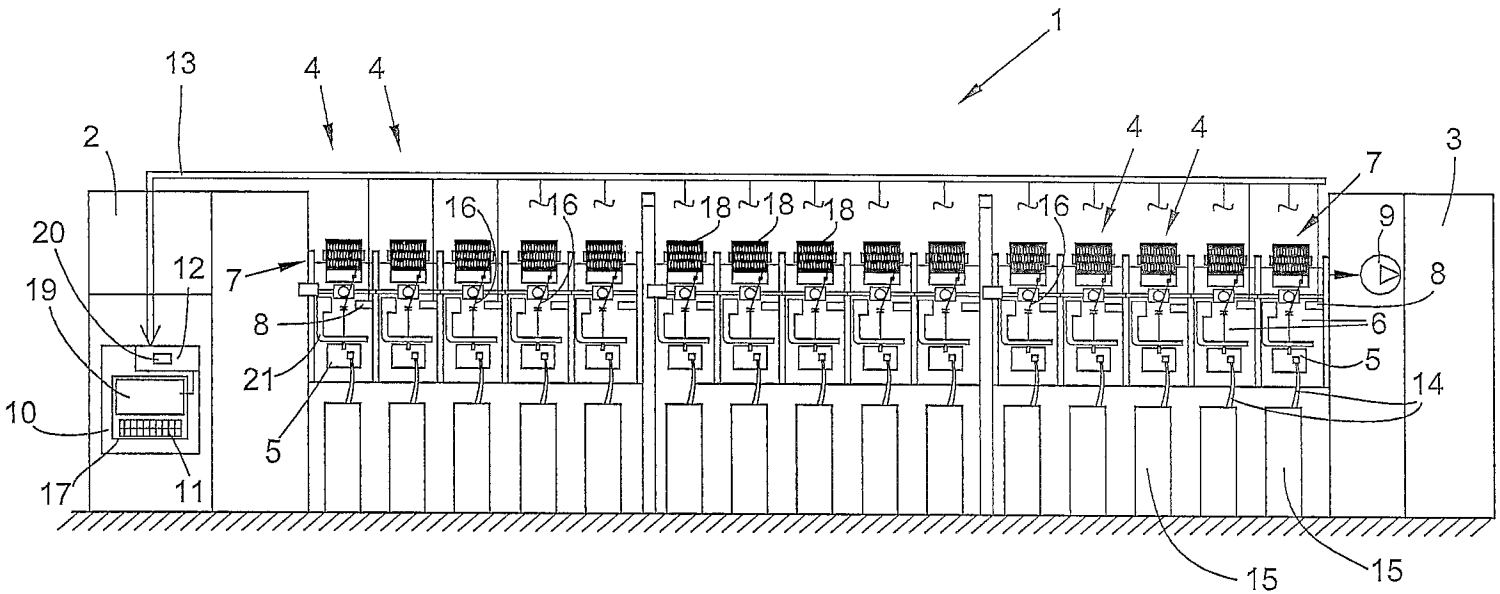
FIG. 1 shows an open-end rotor spinning machine.

FIG. 1 schematically shows a front view of an open-end rotor spinning machine 1. The open-end rotor spinning machine 1 has a large number of substantially self-sufficient workstations 4 arranged between two end frames 2 and 3. The ends frames 2, 3 of this open-end rotor spinning machine 1, are, as known and therefore not shown in more detail, connected by means of continuous supply and disposal channels, for example a negative pressure channel for supplying the spinning devices 5 arranged in the region of the workstations 4 with negative spinning pressure, an electronic channel for a bus system 13 as well as a cable channel for supplying the workstations 4 with electric energy. The yarn formation and winding mechanisms of the workstations 4 are fixed by means of workstation housings 6 on these supply and disposal channels, which virtually represent the "backbone" of the open-end rotor spinning machine 1.

The workstation housings 6 releaseably arranged on the supply and disposal channels have, for example, in each case a spinning device 5, a winding device 7 as well as a control mechanism 8 particular to the workstation.

A negative pressure source 9 particular to the textile machine is arranged in the end frame 3, while an electric energy supply (not shown) as well as a central control unit 10 of the open-end rotor spinning machine 1 are integrated in the end frame 2.

The central control unit 10, which has a computer mechanism 12 with a memory 20, is connected to the control mechanisms 8 of the individual workstations 4 by means of a bus system 13 or the like. The central control unit 10 furthermore has an operating unit 17. It is possible by means of the operating unit 17 to input and display parameters, which are required to control the open-end rotor spinning machine 1 and the workstations 4. For this purpose, the operating unit 17 has a mechanism 11 configured as a keyboard to input the parameters and a display means 19 configured as a screen. The screen 19 can also be configured as a touch screen and thus take on an additional input function. A touch screen of this type is above all suitable to carry out a selection within a menu. The input parameters are stored in the memory 20 of the computer mechanism 12. Furthermore, the memory 20 contains information as to which parameters are to be adjusted in a specific type of change of the mode of working of the open-end rotor spinning machine 1. For this purpose, groups of parameters are associated with the types of change of the mode of working.

As can be seen from FIG. 1, in each case by means of the spinning device 5, a feed fiber band 14, which is stored in spinning cans 15, which are positioned next to one another in a row below the workstations 4, is spun on the numerous workstations into a yarn 16, which is then wound on the winding device 7 to form a cross-wound bobbin 18.

Figure 2:
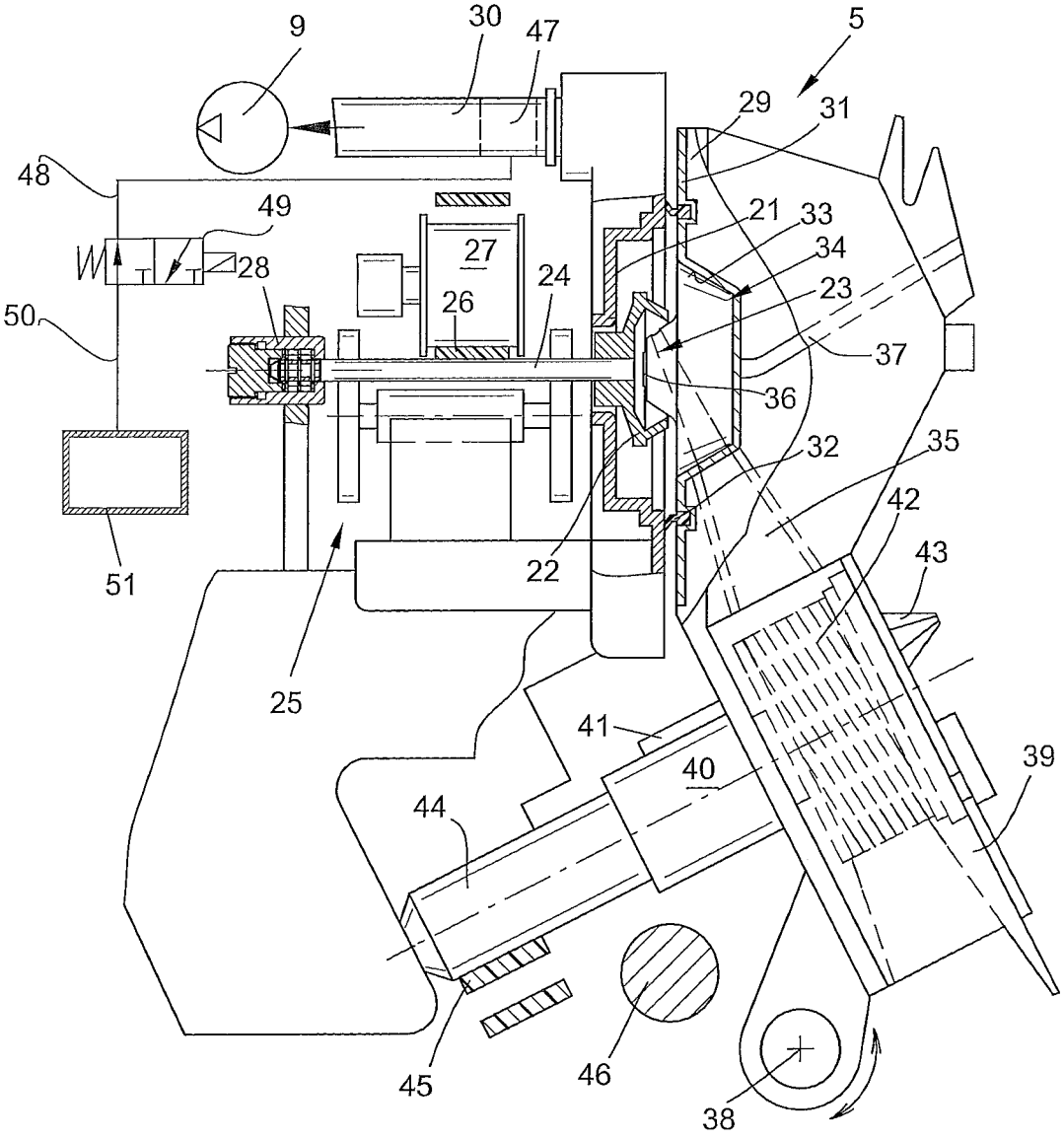
FIG. 2 schematically shows, in a side view, an open-end spinning device with a spinning rotor revolving in a rotor housing, to which negative pressure can be applied, and a fiber band opening mechanism, which is connected by a fiber guide channel to the rotor housing.

The spinning device of an open-end rotor spinning machine 1 shown in FIG. 2 has the reference numeral 5 overall.

Spinning devices 5 of this type, as known, have a rotor housing 21, in which the spinning cup 22 of a spinning rotor 23 revolves at a high rotational speed.

The spinning rotor 23 with its rotor shaft 24 is supported in the bearing interstice of a support disc bearing arrangement 25 that is preferably free of axial thrust in the spinning device 5 according to the present embodiment.

The spinning rotor 23 is driven here by a tangential belt 26 along the length of the machine, which is set on the rotor shaft 24 by a tension roller 27.

The axial positioning of the rotor shaft 24 in the bearing interstice of the support disc bearing arrangement 25 preferably takes place by means of a permanent magnet axial bearing 28.

In an alternative embodiment, the spinning rotor 23 could obviously also be driven by a single motor and be contactlessly supported, for example, in a permanent magnet bearing arrangement.

The rotor housing 21 that is open per se to the front is closed during spinning operation by a pivotably mounted cover element 29 and connected by means of a suction channel 30 to a negative pressure source 9, which produces the necessary negative spinning pressure in the rotor housing 21 during the spinning process.

The cover element 29 has a channel plate 31 with a seal 32 preferably positioned in an annular groove.

A channel plate adapter 34, which has the mouth region of a fiber guide channel 35, is also, as known, exchangeably arranged in a central bearing receiver 33 of the channel plate 31.

Furthermore, the channel plate adapter 34 is equipped with a yarn withdrawal nozzle 36 and, on the exit side, with a yarn withdrawal tube 37.

As is also shown in FIG. 2, an opening roller housing 39 is fixed on the cover element 29, which is rotatably mounted to a limited extent about a pivot axis 38, or the opening roller housing 39 is integrated in the cover element 29, which, furthermore, has rear bearing brackets 40, 41 to mount an opening roller 42 or a fiber band feed cylinder 43.

The opening roller 42 driven here in the region of its wharve 44 by a revolving tangential belt 45 along the length of the machine, while the drive (not shown) of the fiber band feed cylinder 43 preferably takes place by means of a screw gearing arrangement, which is connected to a drive shaft 46 along the length of the machine In an alternative embodiment, single motor drives for the opening roller 42 and/or the fiber band feed cylinder 43 can obviously also be provided here.

During the regular spinning process, the yarn 16 produced in the spinning device 5, to which negative pressure is applied, is drawn off by the yarn withdrawal mechanism and then wound on the winding device 7 to form a cross-wound bobbin 18.

At the same time, the yarn 16 running onto the bobbin is displaced by means of the yarn traversing mechanism (not shown) in such a way that it runs in crossing layers on to the lateral surface of the cross-wound bobbin 18.

If, for example, a yarn break occurs at one of the workstations 4 of the open-end rotor spinning machine 1, this is detected by the stop motion, the spinning process is interrupted and the relevant workstation 4 is stopped.

Stated more precisely, the drive of the fiber band feed cylinder 43 is switched off to interrupt the fiber feed to the opening roller 42 and therefore ultimately into the spinning rotor 23, and the lifting of the cross-wound bobbin 18 from the bobbin drive roller is initiated so that the yarn end 16 cannot mill into the cross-wound bobbin surface 18.

At the same time, the magnetic valve 50 receives a corresponding signal. Thereupon the magnetic valve 50 switches and the passage between the pressure line 48 and the pressure line 49, which is connected to a ring line 51, is opened. The ring line 51 applies excess pressure to a large number of workstations 4. The compressed air from the ring line 51 flows through the pressure lines 48 and 49 into the squeezing valve 47 and closes the pressure line 30. The rotor housing 21 no longer has negative pressure applied.

As the yarn end 16 is generally drawn out of the spinning box because of the high winding speed after the yarn break, the yarn end 16 has to be found on the cross-wound bobbin 18 lifted from the bobbin drive roller and some layers have to be unwound therefrom.

Once the yarn end 16 has been prepared for the following piecing and a pieceable fiber tuft has been produced on the yarn end 16, the yarn end 16 has to be introduced counter to the normal withdrawal direction through the yarn withdrawal tube 37 and the withdrawal nozzle 26 in the direction of the spinning rotor 23. Once the control mechanism of the workstation 4 has been activated by means of a switching element, not shown, the magnetic valve 50 receives the signal for closing. Thereupon, the squeezing valve 47 opens and the pressure in the pressure line 48 reduces. The rotor housing again has the necessary negative pressure for spinning applied.

At the same time, the fiber band feed cylinder 43 is driven and the fiber band 14 is again fed to the opening roller 42 and therefore the spinning rotor 23, in the collecting groove of which a fiber ring again forms due to the high centrifugal acceleration. The prepared yarn end 16 slides into the rotor groove.

Negative pressure, which suctions the yam end 16 into the spinning rotor 23, prevails again in the spinning rotor 23, so the prepared yam end 16 is connected to the fiber ring in the collecting groove of the spinning rotor 23. At the same time, the creel lowers until the cross-wound bobbin 18 again rests on the bobbin drive roller and the yam 16 being newly produced is wound on to the cross-wound bobbin 18.

If a restart of the machine or a run up after a power failure takes place, the control mechanisms of the first twenty workstations 4 are activated by means of switching elements, not shown. Thereupon, the corresponding magnetic valves 50 close at these twenty workstations 4 and the squeezing valves 47 open. The pressure in the pressure line 48 of the respective workstations 4 decreases as a result and the selected workstations 4 have adequate negative pressure applied, so new yarns can be pieced. Once the first twenty workstations 4 have ended the piecing process, the next twenty workstations 4 can have negative pressure applied for piecing.

The present invention has been herein described in relation to an exemplary embodiment or embodiments for purposes of providing an enabling disclosure of the invention. However, it will be understood by persons skilled in the relevant art that the present invention is susceptible of a broader utility and application. Accordingly, it is to be expressly understood that the present invention is not to be construed as limited to the embodiments, features and aspects herein described, but only according to the appended claims.

What is claimed is:

1. Method for operating an open-end rotor spinning machine (1) having a plurality of workstations (4), each workstation having a spinning device (5) with a rotor housing (21) to which negative pressure can be applied, a spinning rotor (23) supported in the rotor housing for rotation at a high rotational speed to produce a yarn (16), and a winding device (7) to produce a cross-wound bobbin (18), and wherein the spinning machine includes a connection of the workstations (4) to a central negative pressure supply and a device for selectively activating and deactivating the connection between the workstations and the negative pressure supply, characterized in that the device for selectively activating and deactivating the connection between the workstations and the negative pressure supply includes means for selectively connecting the negative pressure supply only to one or more groups of workstations (4) comprising less than all workstations and only comprising workstations which are producing yarn and workstations that are temporarily inoperative while repiecing the yarn associated herewith.

* * * * *